US006804869B1

(12) United States Patent
Tong

(10) Patent No.: US 6,804,869 B1
(45) Date of Patent: Oct. 19, 2004

(54) MULTI-PURPOSE TOOL

(76) Inventor: Kam Por Paul Tong, 24/F., Flat C, Block 1, Victoria Centre, 15 Watson Road, Hong Kong (HK)

( * ) Notice: Subject to any disclaimer, the term of this patent is extended or adjusted under 35 U.S.C. 154(b) by 167 days.

(21) Appl. No.: 10/144,173

(22) Filed: May 13, 2002

(51) Int. Cl.[7] ..... B25B 9/02
(52) U.S. Cl. ..... 29/426.1; D8/16; 294/99.2
(58) Field of Search ..... 254/25; 7/166; 29/426.1, 268; 249/66.1, 69; 81/3.8, 44; D8/16, 17, 19; 294/2, 99.2, 148

(56) References Cited

U.S. PATENT DOCUMENTS

| | | | | | |
|---|---|---|---|---|---|
| 187,871 | A | | 1/1877 | Langerfeld | |
| 743,183 | A | | 11/1903 | Miller | |
| 1,101,845 | A | | 6/1914 | Graue | |
| 1,426,249 | A | * | 8/1922 | Bochonok | 81/44 |
| 2,021,007 | A | | 11/1935 | Holland | |
| 2,687,540 | A | | 8/1954 | Noll | |
| 4,079,764 | A | * | 3/1978 | Hayes | 81/44 |
| 5,077,879 | A | * | 1/1992 | Haviv | 29/268 |
| 5,387,019 | A | * | 2/1995 | Britzke, II | 294/2 |
| 5,469,614 | A | * | 11/1995 | Lyonnais | 29/764 |
| 5,695,171 | A | | 12/1997 | Shine | |
| 6,324,741 | B1 | * | 12/2001 | Brown | 29/270 |

* cited by examiner

*Primary Examiner*—Lowell A. Larson
(74) *Attorney, Agent, or Firm*—Schweitzer Cornman Gross & Bondell LLP

(57) ABSTRACT

A multi-purpose tool is designed for use in connection with the assembly and disassembly of mosaic-type craft projects in which flanged mosaic pieces are mounted in a grid. The tool has at least one offset piece-engaging ends terminating in a pair of tapered speed arms. The arms are adapted to engage about a flange piece and are spaced to allow the tool to serve as a punch to remove inserted mosaic pieces.

8 Claims, 5 Drawing Sheets

FIG. 12
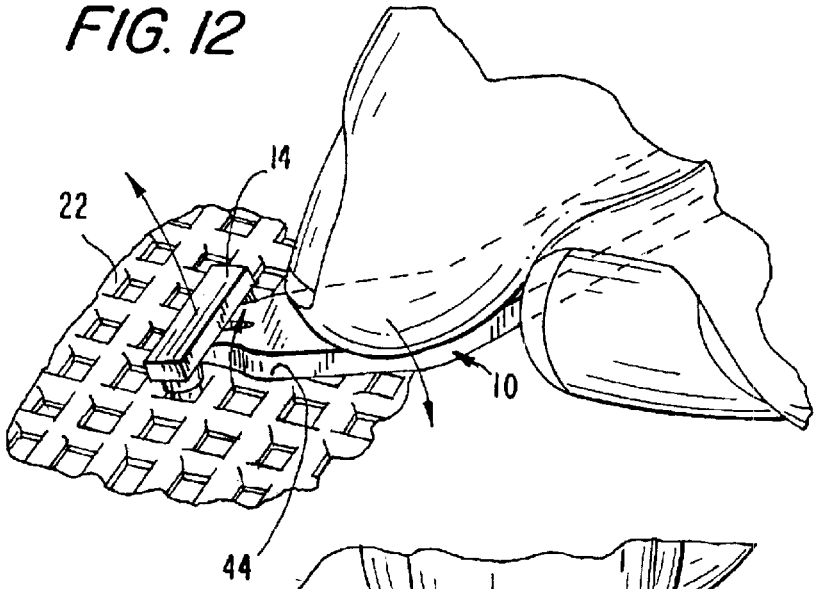
FIG. 13
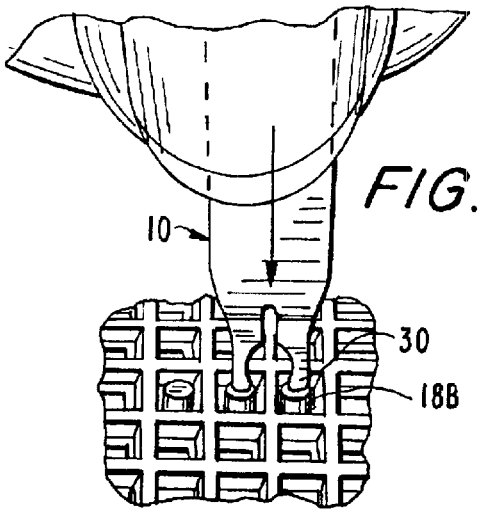
FIG. 14
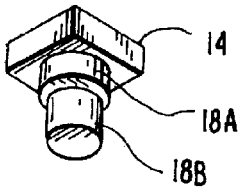
FIG. 15
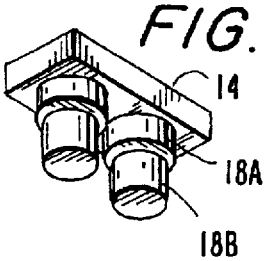
FIG. 17
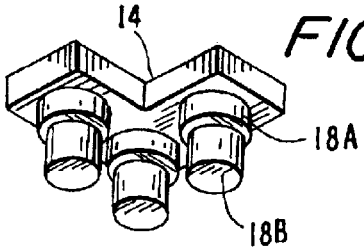
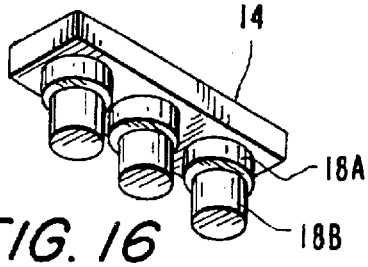
FIG. 16
FIG. 18
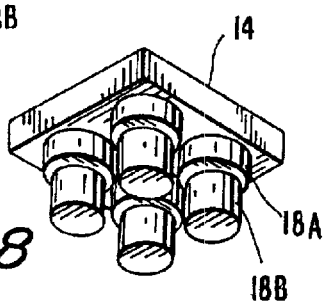

MULTI-PURPOSE TOOL

The present invention is directed to a new and improved multi-purpose tool and, in particular, a multi-purpose tool useful in connection with the construction of mosaic-type craft projects and the like.

BACKGROUND OF THE INVENTION

The construction of mosaic designs, in which a plurality of individually colored elements or pieces are arranged in a matrix form to provide an overall design is well known. The use of colored stones and ceramic pieces goes back to antiquity. Current craft sets typically utilize molded plastic pieces. Rather than requiring that the plastic pieces be placed in an adhesive, mastic or mortar matrix, a grid or frame element constructed with columns and rows of apertures into which the plastic elements may be mounted, is provided. To assist the user, typically a child, in choosing the correct pieces to form a desired design, a pattern is provided, either in the form of a sheet over which the grid or frame is placed, or alternatively as embossments or printing on the frame itself. The user creates the picture by following the template formed by the pattern, inserting the appropriately colored pieces into the grid. The pieces are usually removable and re-usable.

The individual pieces to be inserted into the grid or frame are typically of small dimension. It is thus often difficult to pick up an individual piece, orient it properly and inserted into the grid in the proper position. For a child, in particular, the inability of the child to smoothly perform the process may be a source of irritation and frustration, decreasing the play value and interest of the craft set. Further, despite the care with which the pieces are picked up and aligned, it is not uncommon for a piece to be placed into an incorrect grid position. It thus becomes necessary to remove the piece from the grid in a non-destructive manner to allow it to be replaced. Still further, the construction of the pieces and grid are such that a snug friction-fit is provided to insure that, when the piece is inserted, it does not easily become dislodged. As a typical mosaic picture may utilize several hundred pieces, it is vitally important that, once placed in position, the mosaic piece does not inadvertently fall out of position. Yet the piece should be removable.

Heretofore, the pickup, positioning, insertion and removal of mosaic pieces have been done in a totally manual manner. It is accordingly the purpose of the present invention to provide a multi-purpose tool which facilitates the pickup, positioning, insertion and removal of mosaic-like pieces.

It is a further purpose of the present invention to provide such a multi-purpose tool displaying efficiencies of use which allows its use by both children and adults.

It is yet a further purpose of the present invention to provide such a tool which is of economical construction and design.

BRIEF DESCRIPTION OF THE INVENTION

In accordance with the foregoing and other objects and purposes, a multi-purpose tool in accordance with the present invention is particularly adapted and arranged to be utilized with small objects, such as mosaic pieces, having one or more flange-like protrusions extending from a piece body, the protrusions being adapted and arranged to be insertable into corresponding apertures in a surface, such as a pattern matrix.

The tool is of elongated construction, having a main handle portion with at least one offset end. The end is in the form of a pair of spaced arms, the spacing therebetween being chosen to allow the arms and tool to surround and grip a flange of a piece to be moved. At least the end of the tool is constructed of a resilient material, allowing the flange to be gripped by the tool end. With the flange being gripped by the tool, the tool and piece may be manipulated, turned and aligned as needed to allow the flange to be introduced into the desired matrix aperture.

The end of the tool is further of a tapered thickness. This permits the tool end to fit between the body of the piece and the aperture matrix when the piece is being aligned with the matrix and, the flange inserted into the desired matrix aperture. The tool end further includes a flat surface extending proximate the arms, allowing finger pressure to be placed on both the tool and held piece to allow the piece to be further fitted into the aperture. The tool then can be removed from the piece. With the tool removed, the flat, lower surface of the tool may be placed on top of the mosaic piece providing once again an increased pressing surface for the user's thumb, allowing the piece to be firmly driven home.

The tapered construction also allows the tool to be inserted between an inserted mosaic piece and the matrix. The offset between the end and the main body of the tool allows the tool to serve as a pry bar to remove the piece from the grid. With the piece slightly raised out of the matrix, the tool may be further inserted, whereby a flange is gripped by the tool, allowing the piece to be retained by the tool as the piece is fully removed from the grid by the tool.

The on-center spacing of the tool arms correspond to the center-to-center spacing of the grid apertures for the mosaic pieces and accordingly to the center-to-center spacing of the flanges on a multiple flange mosaic piece. The tool may thus also be used as a punch-removal tool, the arms of the tool being aligned with two of the flanges projecting through the grid. Downward pressure on the tool ejects the mosaic piece from the matrix.

BRIEF DESCRIPTION OF THE DRAWINGS

A fuller understanding of the present invention and the features and benefits thereof will be accomplished upon review of the following detailed description of a preferred, but nonetheless illustrative embodiment thereof, when reviewed in conjunction with the annexed drawings, wherein:

FIG. 12 is a perspective view illustrating how the tool may be used to remove a mosaic piece from a mosaic grid;

FIG. 13 is a perspective view illustrating how the tool may be used as a removal punch;

FIG. 14 is a perspective view of a single flange mosaic piece;

FIG. 15 is a perspective view of a two-flange mosaic piece;

FIG. 16 is a perspective view of a linear mosaic piece having three flanges;

FIG. 17 is a perspective view of a right-angle mosaic piece having three flanges; and FIG. 18 is a perspective view of a block mosaic piece having four flanges.

DETAILED DESCRIPTION OF THE INVENTION

Figure 1:
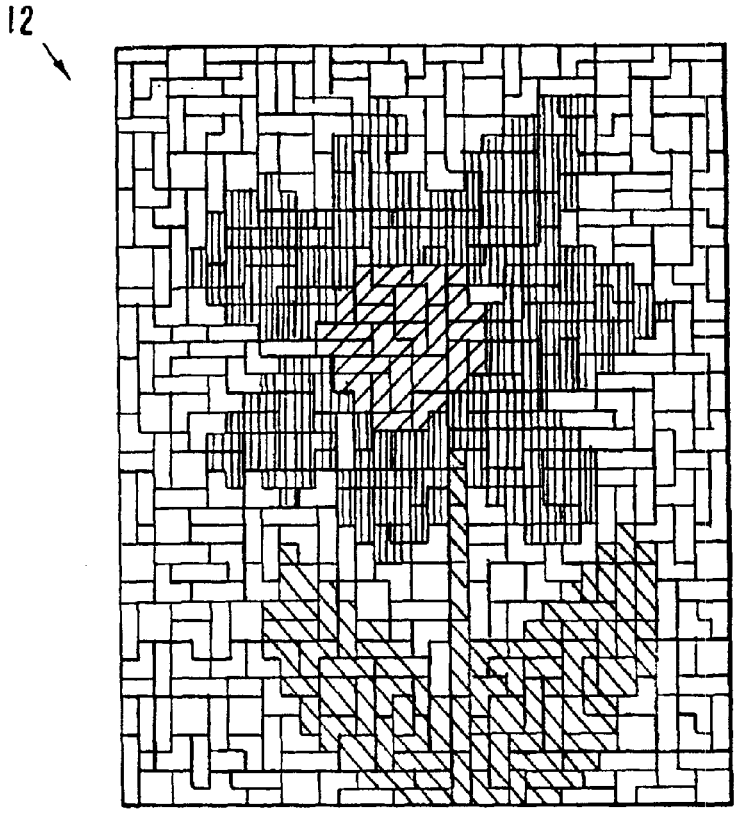
FIG. 1 is a plan view of a mosaic picture constructed of mosaic elements with which the present tool may be employed.
Figure 2:
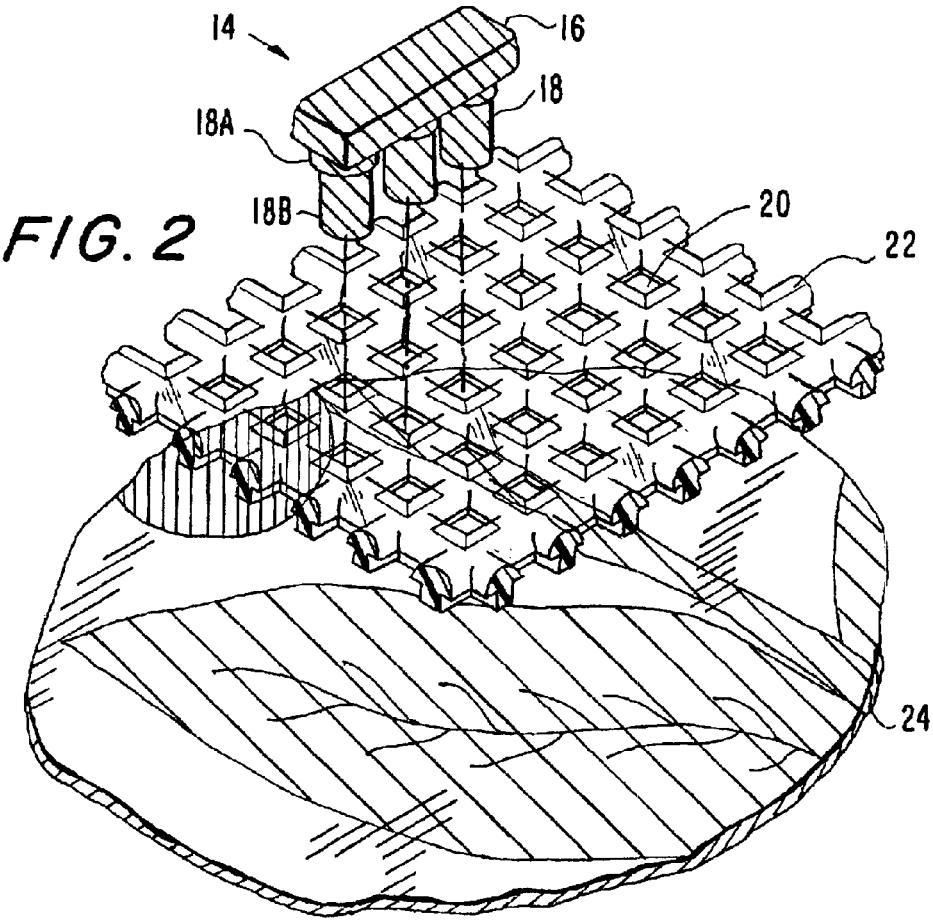
FIG. 2 is a detailed perspective view of a portion of a mosaic grid depicting a mosaic piece to be inserted therein.
Figure 3:
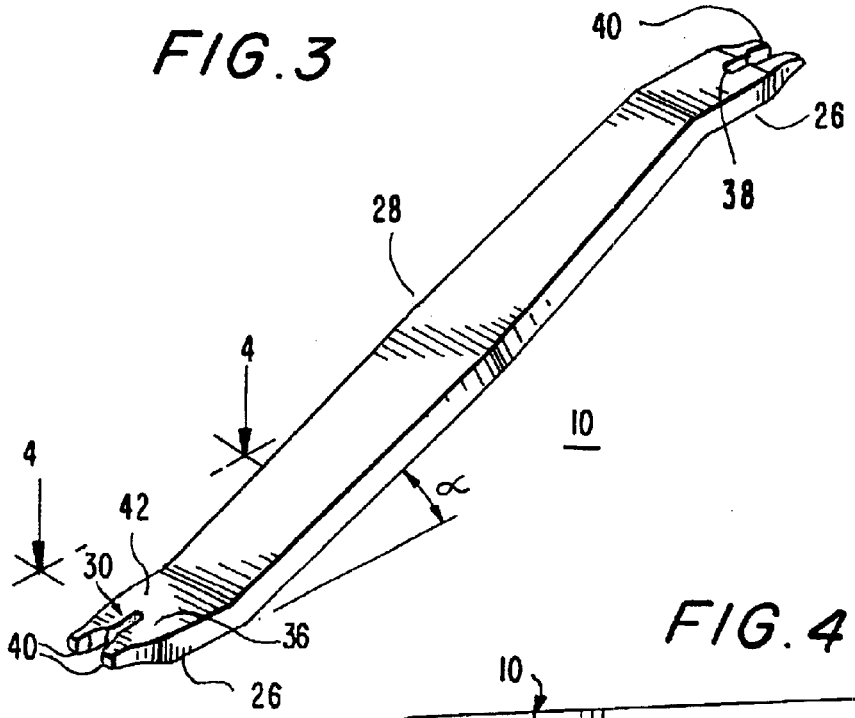
FIG. 3 is a perspective view of a multi-purpose tool of the present invention.
Figure 4:
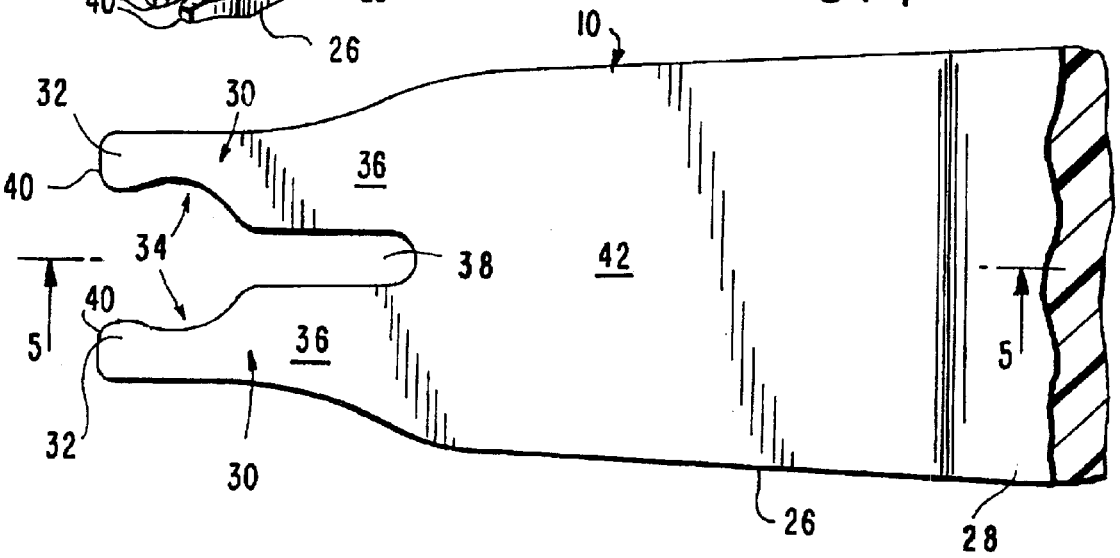
FIG. 4 is a detail plan view of a portion of the tool taken along line 4—4 in FIG. 3.

With initial reference to FIGS. 1, 2 and 3, the tool 10 of the present invention as depicted in FIG. 3 may be used in connection with the assembly and disassembly of a mosaic picture 12, as shown in FIG. 1. Mosaic picture 12 is created from a plurality of mosaic pieces 14, which may be of several different shapes as shown in FIGS. 14–18, but are each characterized by a main body portion 16, dimensioned to interfit with and abut against the main body portions of adjacent mosaic pieces 14, and one or more downwardly-extending legs or flanges 18. The mosaic pieces 14, which are of different colors, are mounted by the flanges upon mosaic grid 22. The flanges 18 are located or positioned to be inserted into corresponding apertures 20, the apertures being laid out in a regular pattern in the grid 22. As known, the flanges are typically of a stepped construction, having a first diameter upper flange portion 18A and a lower flange portion 18B of lesser diameter, conforming to the dimensions of the grid apertures. As may be seen in FIG. 11, the inserted mosaic piece 14 sits with the bottom edge of upper flange portion 18A wedged against the arcuate side walls of the grid surrounding the aperture. The grid 22 is preferably transparent, allowing a pattern 24 to be positioned thereunder, the pattern being observable through the grid to allow the user to choose the appropriately colored and shaped mosaic pieces 14 to be inserted into the grid to replicate the design shown on the pattern.

As shown in FIG. 3, the tool 10 is of an elongated construction, formed of an appropriate tough but resilient plastic, and may have a central handle-forming section 28 and mosaic piece-engaging sections 26 at one or both ends. Each of the piece-engaging sections 26 may be offset from the central handle section 28 of the tool. The offset angle $\alpha$ may be in the range of 20 to 30 degrees.

Figure 5:
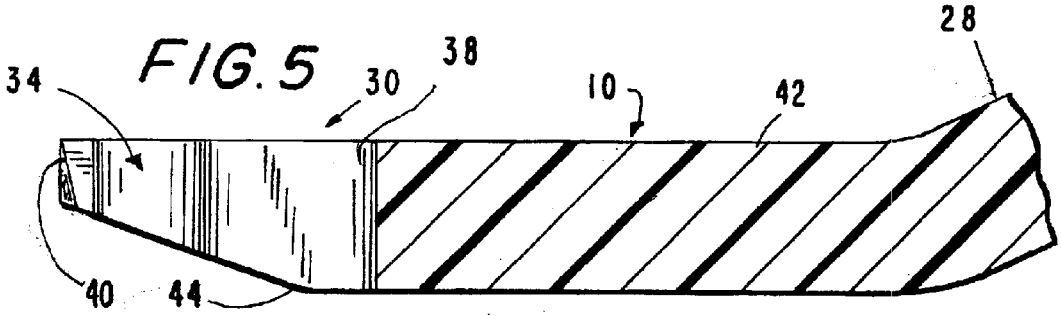
FIG. 5 is a sectional view of the tool portion taken along line 5—5 of FIG. 4.

Each of the piece-engaging end sections 26 is formed with a pair of prongs or arms 30. Each of the arms 30 comprises a distal portion 32 having an arcuate inner wall 34 dimensioned and adapted to surround and frictionally engage the upper, wider portion to flange portion 18A of a mosaic piece. See FIG. 8. The interior portions 36 of the arms are separated by a relatively thin slot portion 38. The existence of the slot 38 between the arms provides for a degree of flexibility for the arms, allowing the arms to flex about a mosaic piece flange and grip the flange in a relatively tight manner. As detailed in FIG. 5, the tool arms 30 are also of a tapered thickness over a substantial portion of their length, the bottom surfaces of the arms being angled upwards towards the distal ends of the arms at an angle of about 20–30 degrees from support or pivot point 44. The tapered construction facilitates insertion of the tool between an installed mosaic piece and the grid for piece removal, as will be explained. Preferably, the center-to-center spacing of the tips 40 of the arms corresponds to the center-to-center spacing of the apertures 20 of the grid 22, and thus further corresponds to the center-to-center spacing of the flanges 18 on a mosaic piece 14.

Figure 6:
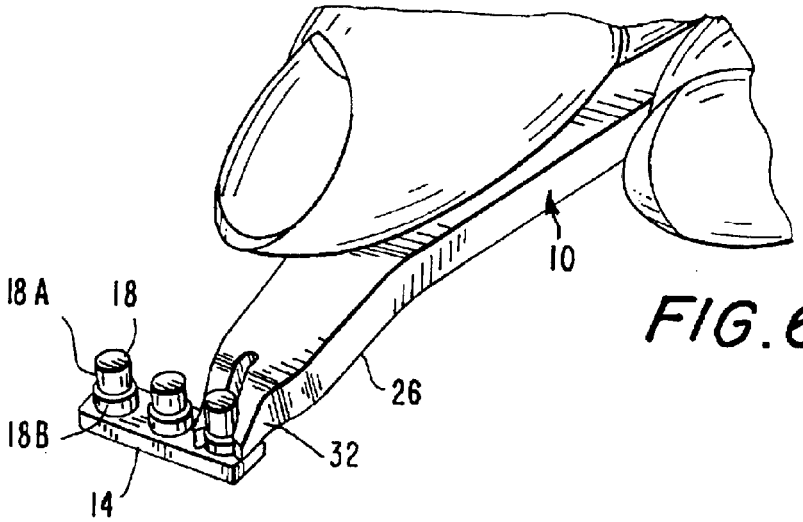
FIG. 6 is a perspective view illustrating how a mosaic piece may be held by the tool.
Figure 7:
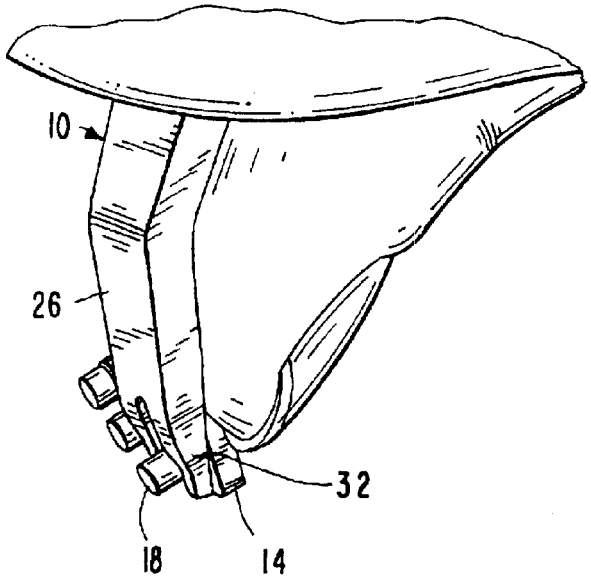
FIG. 7 is a perspective view detailing a second method by which the mosaic piece may be held by the tool.
Figure 8:
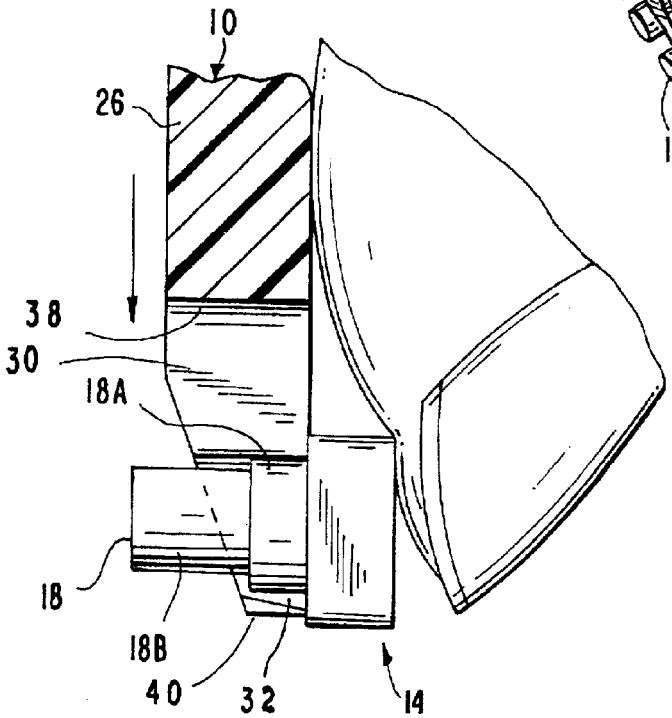
FIG. 8 is a detail view depicting the relationship of the tool and piece of FIG. 7.

The varied operations which may be performed by the tool 10 are depicted in FIGS. 6–13. FIG. 6 depicts a first method of grasping of a mosaic piece 14 by the tool. The distal portions 32 of the arms 30 are positioned around and pressed down about flange portion 18A which is thereby gripped by the arms and tool. The mosaic piece can then be moved and positioned as desired. Alternatively, and as depicted in FIGS. 7 and 8, the tool may approach the mosaic piece and flange perpendicular to the flange 18, the tool arms 30 flexing about and gripping the flange portion 18A from the side. The mosaic piece 14 can be supported by the user's thumb as the tool engages the piece. In each case, the top surface of the tool faces the top of the mosaic piece.

Figure 9:
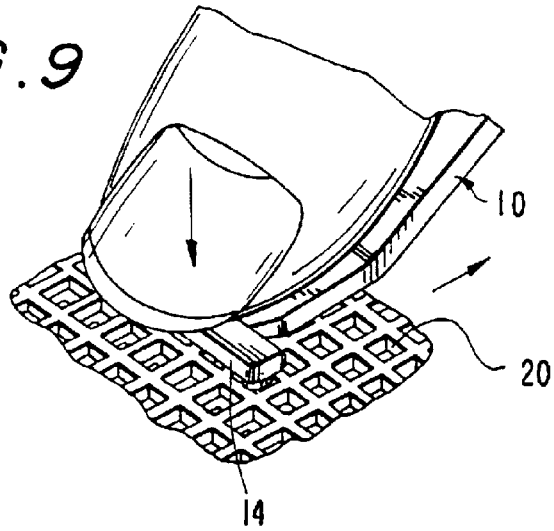
FIG. 9 is a perspective view illustrating a first step in utilizing the tool for the insertion of a mosaic piece into a mosaic grid.
Figure 10:
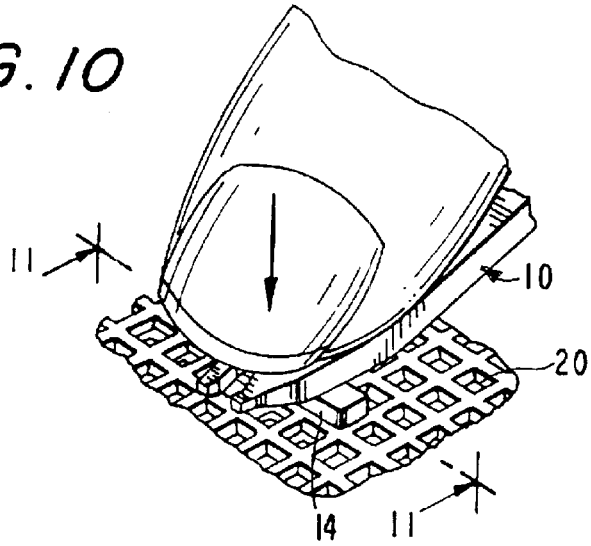
FIG. 10 is a perspective view of a second step of the insertion procedure.
Figure 11:
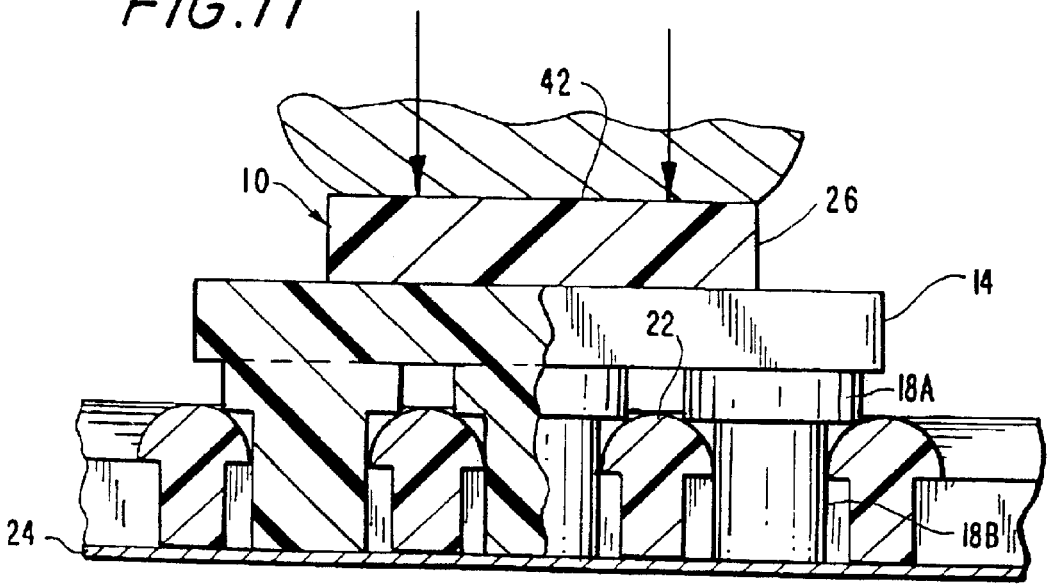
FIG. 11 is a sectional view taken along line 11—11 of FIG. 10.

As depicted in FIGS. 9–11, with a piece held by the tool, the tool can be used as an insertion device, assisting in placing the mosaic piece 14 into the mosaic grid 22. In such a procedure, the gripped mosaic piece is aligned with the grid as desired, with the distal, smaller diameter portions 18B of the flanges 18 placed within the corresponding grid apertures 20. Finger pressure is then applied to the mosaic piece in the grid, as depicted in FIG. 9, gently seating the piece. The tool 10 is then backed off from the piece by moving it in a direction parallel to the top surface of the grid, disengaging the arms 30 from the flange 18. The tool is then placed on top of the mosaic piece, as depicted in FIGS. 10 and 11, the flat, lower surface of the piece-engaging portion 26 behind the arms being in contact with the top of the mosaic piece, and downward finger pressure is applied to the top surface 42 of the piece-engaging portion. The increased surface area of the tool, as opposed to the top of the mosaic piece, provides a comfortable surface for the finger, transferring the downward force applied by the finger to the mosaic piece to firmly seat the piece within the grid 22, such that the lower flange portions 18B engage the grid walls as seen in FIG. 11.

After a piece has been inserted into the grid, it can be removed with the tool as depicted in FIG. 12. The arms 30 of the tool are slid between the main body portion of the mosaic piece and the grid, the tapered construction of the arms facilitating entry therebetween and lifting the piece away from the grid. With the tool fully inserted, preferably with the arms surrounding and engaging the upper flange portion 18A of the piece, the tool may be levered about pivot point 44 to fully remove the piece from the grid.

The tool may be also used as a punch, to extract a mosaic piece 14 from the grid, as depicted in FIG. 13. As shown therein, the mosaic grid 22 is inverted to expose the protruding flange ends of the piece to be removed. The tips of the arms 30 are aligned with two adjacent flanges on a piece to be removed, the tool being positioned generally parallel to the flanges and thus perpendicular to the grid 22. Downward pressure applied to the tool drives the mosaic piece out of the grid. For a single-flange piece, such as depicted in FIG. 14, the tool may be canted to engage the flange with one of the tips while the other tip is out of contact with flanges of adjacent pieces.

I claim:

1. A multi-purpose tool for use in conjunction with the insertion and/or removal of flanged pieces into and from a grid having flange-receiving bores, the tool comprising:

an elongated handle;

a piece-engaging end having a flat, upper surface at least a first end of the handle, the piece-engaging portion being offset from a length of the handle;

the piece-engaging portion terminating at a distal end in a pair of spaced arms, the arms having of a tapered thickness portion extending downward to tips thereof and having first opposed inner wall portions adjacent the distal end and dimensioned and spaced from each other to flex about conform to and frictionally receive at least a portion of a piece flange.

2. The multi-purpose tool of claim 1, wherein the arms further include second opposed parallel inner wall portions remote from the distal end spaced from each other and extending inwardly from the first wall portions to provide flexibility to the arms for the frictional receipt of the flange piece by the first wall portions.

3. The multi-purpose tool of claim 2, wherein piece-engaging ends are located at opposed first and second ends of the handle.

4. The multi-purpose tool of claim 1, wherein a bottom surface of the tapered thickness portion of the arms is offset from an adjacent bottom surface portion to form the tapered thickness portion.

5. A method of use for the multi-purpose tool of claim 1, comprising the steps of:

engaging a flange of a flanged piece with the first wall portions of the spaced arms of the tool;

positioning the flanged piece in alignment with the grid, whereby a flanges of the piece is received by a bores of the grid;

applying finger pressure to a top of the piece to initially set the piece within the bores;

disengaging the piece from the tool; and placing a bottom surface of the piece-engaging portion of the tool on the piece and applying finger pressure to the flat upper surface of the tool to fully set the piece in the grid.

6. The method of claim 5 further comprising the steps of:

inserting the piece-engaging portion of the tool between the piece and the grid; and levering the tool to remove the piece from the grid.

7. The method of claim 5, wherein the step of inserting the tool between the piece and the grid comprises orienting the tool such that the tool engages a flange of the piece.

8. A method for use of the tool of claim 1, comprising the steps of:

aligning the ends of the spaced arms of the tool about a flange of a piece inserted into the grid and applying pressure to a lower surface of the piece through the tool to piece from the grid.

* * * * *